US005735062A

United States Patent [19]

Sukup

[11] Patent Number: 5,735,062

[45] Date of Patent: Apr. 7, 1998

[54] METHOD AND MEANS FOR TRANSPORTING, DRYING AND UNLOADING LIGHTWEIGHT PARTICULATE MATERIAL

[75] Inventor: Eugene G. Sukup, Hampton, Iowa

[73] Assignee: Sukup Manufacturing Company, Sheffield, Iowa

[21] Appl. No.: 751,998

[22] Filed: Nov. 15, 1996

[51] Int. Cl.[6] ..... F26B 3/00

[52] U.S. Cl. ..... 34/503; 34/580; 62/57

[58] Field of Search ..... 34/503, 580; 62/57

[56] References Cited

U.S. PATENT DOCUMENTS

| | | | |
|---|---|---|---|
| 3,055,116 | 9/1962 | Tisch . | |
| 3,279,094 | 10/1966 | Blanton, Jr. . | |
| 3,529,554 | 9/1970 | Tillander . | |
| 4,114,288 | 9/1978 | Fowler . | |
| 4,177,647 | 12/1979 | Oberbye | 62/57 |

*Primary Examiner*—Ronald C. Capossela
*Attorney, Agent, or Firm*—Zarley,McKee,Thomte, Voorhees, & Sease

[57] ABSTRACT

A method for transporting, drying and unloading lightweight particulate material involves taking a wheeled compartment having forward and rearward ends, a bottom, and opposite sides, forming a false bottom over the bottom to create an air duct therebetween, forming air ports in the false bottom which will deflect forced air passing therethrough from the air duct in a direction generally towards the rearward end, placing a quantity of peanut hulls in the compartment, forcing warm air into the air duct through the air ports and into the compartment to dry the peanut hulls, and moving the rearward end of the compartment to permit the air from the air ports to blow the dried hulls from the compartment out of the rearward end. An apparatus for transporting, drying and unloading lightweight particulate material includes a wheel-mounted frame, a compartment on said frame having a normally horizontal bottom, opposite sides, a forward end, and open top, and a rearward end pivotal gate, a false bottom floor located in the compartment spaced from and substantially parallel to the bottom to create an air duct therebetween, a plurality on laterally extending slits in the false bottom floor with at least some of said slits having an upwardly and rearwardly extending baffle element so that air moving through the slits from the air duct will move upwardly and rearwardly into the compartment, and means associated with the air duct for receiving air under pressure to cause air moved through the slits.

17 Claims, 2 Drawing Sheets

METHOD AND MEANS FOR TRANSPORTING, DRYING AND UNLOADING LIGHTWEIGHT PARTICULATE MATERIAL

BACKGROUND OF THE INVENTION

When peanuts are harvested and remain in their shells, they must be dried and then delivered to an elevator for processing. This normally involves placing the harvested peanut hulls in a stand alone drier; thence loading the dried peanut hulls on a truck or wagon for transporting to the elevator, and then unloading the delivery vehicle. The unloading step is often time consuming.

It is therefore a principal object of this invention to provide a method and means for transporting, drying and unloading lightweight particulate material which can accomplish the drying and transportation steps in one vehicle, and which will greatly enhance the unloading function.

These and other objects will be apparent to those skilled in the art.

SUMMARY OF THE INVENTION

The method of this invention involves taking a compartment, preferably wheel supported, having forward and rearward ends, a bottom, and opposite sides, forming a false bottom over the bottom to create an air duct therebetween, forming air ports in the false bottom which will deflect forced air passing therethrough from the air duct in a direction generally towards the rearward end, placing a quantity of peanut hulls in the compartment, forcing warm air into the air duct through the air ports and into the compartment to dry the peanut hulls, and moving the rearward end of the compartment to permit the air from the air ports to blow the dried hulls from the compartment out of the rearward end. The apparatus of the invention includes a wheel-mounted frame, a compartment on the frame having a normally horizontal bottom, opposite sides, a forward end, and open top, and a rearward end pivotal gate, a false bottom floor located in the compartment spaced from and substantially parallel to the bottom to create an air duct therebetween, a plurality on laterally extending slits in the false bottom floor with at least some of said slits having an upwardly and rearwardly extending baffle element so that air moving through the slits from the air duct will move upwardly and rearwardly into the compartment, and means associated with the air duct for receiving air under pressure to cause air to be moved through the slits.

A BRIEF DESCRIPTION OF THE DRAWINGS

DESCRIPTION OF THE PREFERRED EMBODIMENT

Figure 1:
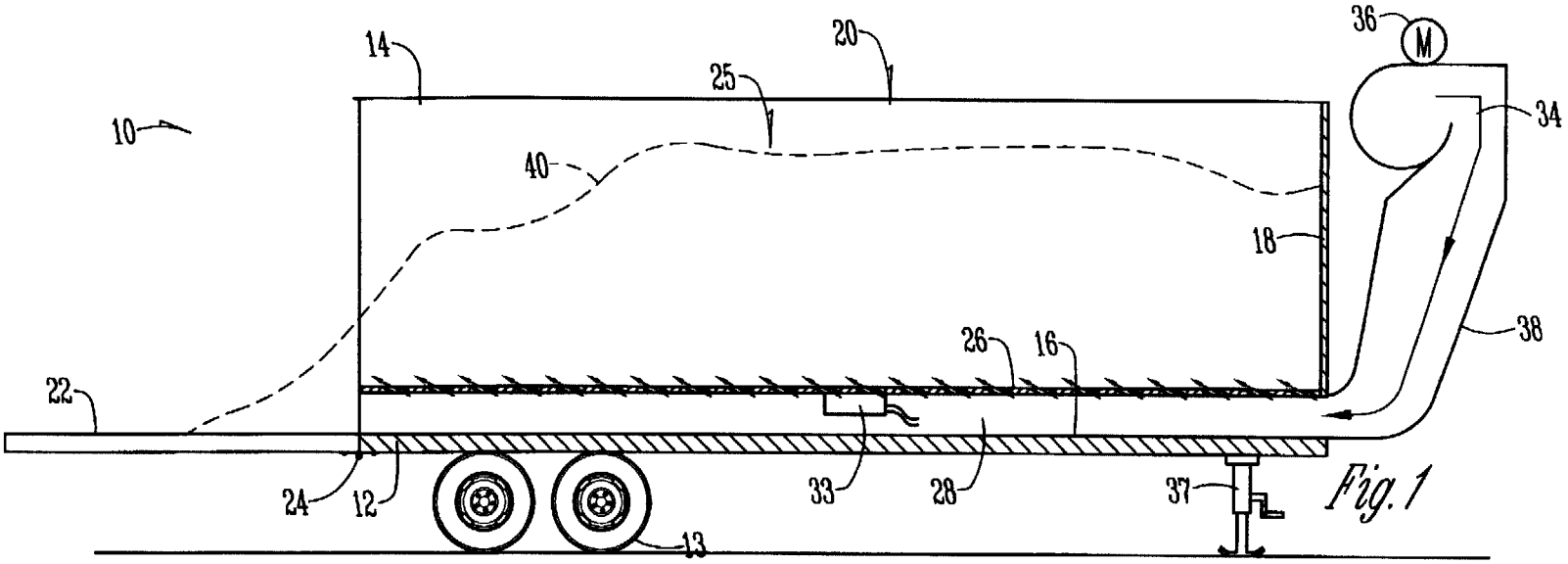
FIG. 1 is a longitudinal sectional view of the device of this invention.

The term "hulls" as used herein contemplates filled peanut shells. A trailer or truck body 10 has a frame 12 and is wheel supported by wheels 13. A suitable tongue or fifth wheel connection (not shown) can be utilized with respect to the trailer 10.

Trailer 10 utilizes opposite sides 14, a bottom 16, and a front wall 18. Trailer 10 also has an open top 20 and a hinged end gate 22 pivotally secured to frame 12 by hinge 24. The sides 14, front 18, and end gate 22 provide a rectangular compartment 25.

Figure 2:
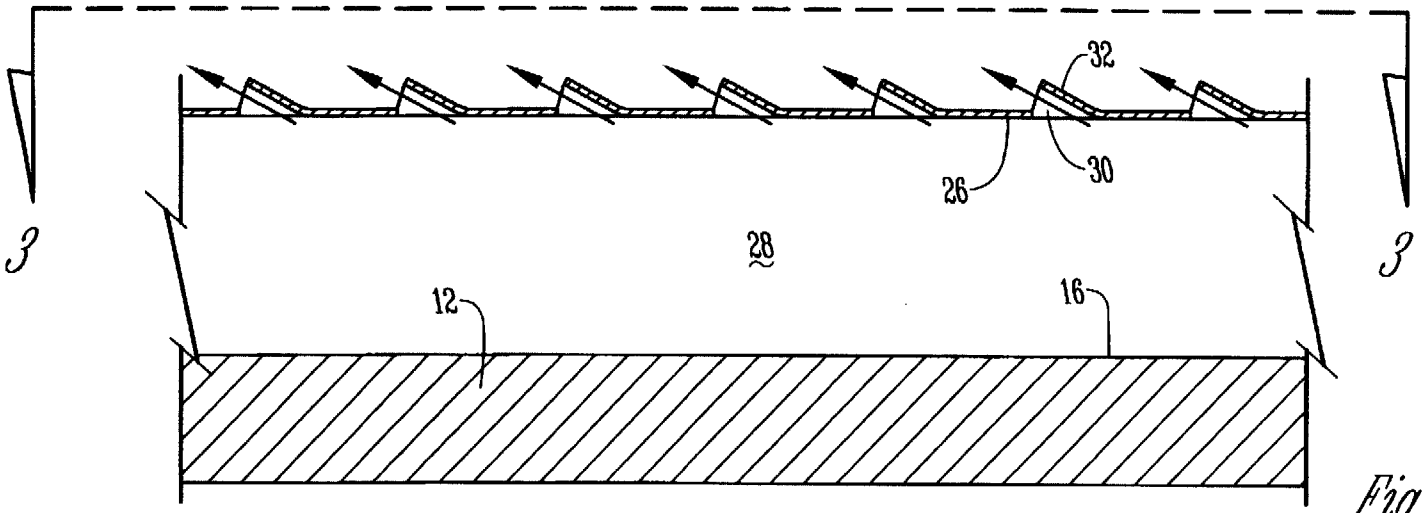
FIG. 2 is an enlarged scale sectional view through the air conduit of the invention.
Figure 3:
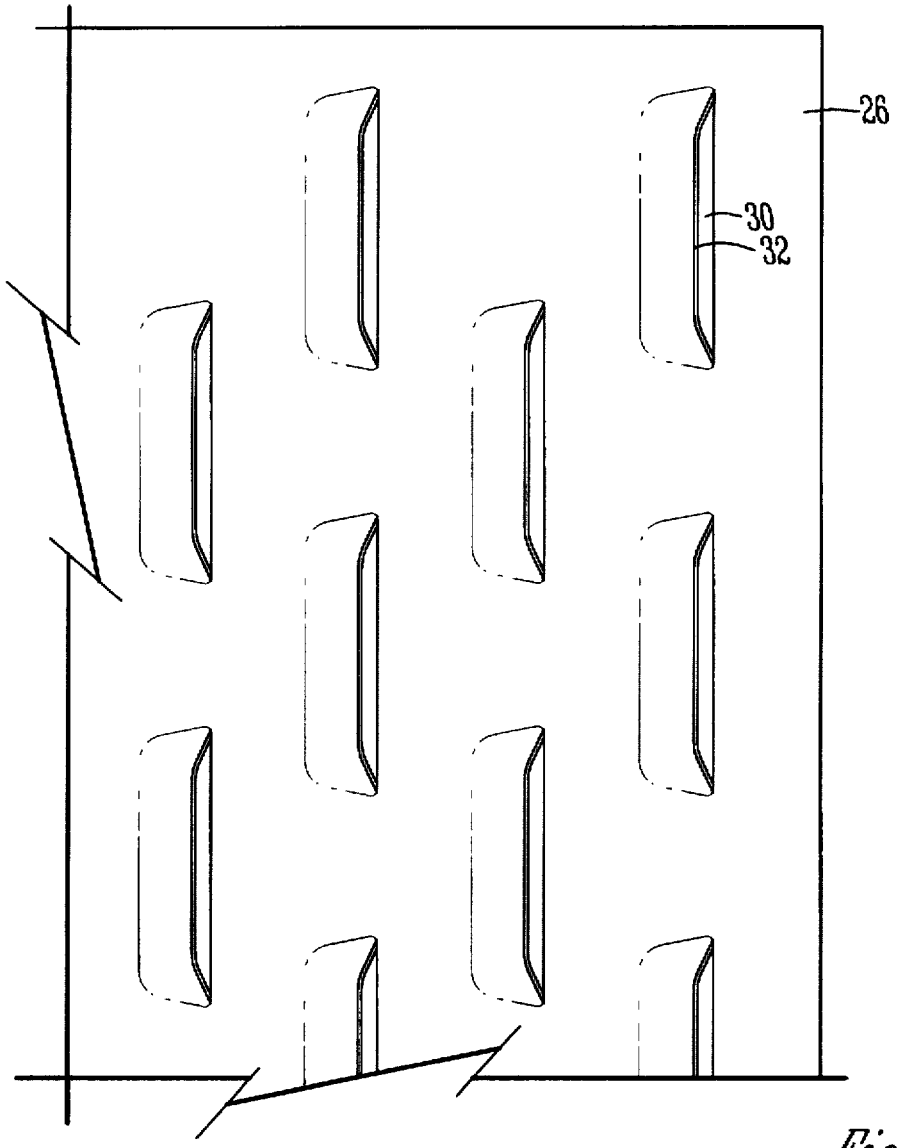
FIG. 3 is a plan view of the false bottom as used in the invention and as taken on line 3—3 of FIG. 2.

A false bottom floor 26 is mounted in the compartment 25 a spaced distance from the bottom 16 to provide air duct 28. The false bottom floor 26 is normally of metal or the like and has a plurality of laterally extending slits 30. Each of the slits 30 has a baffle 32 which extends upwardly and rearwardly so as to permit forced air within conduit 28 to move in the direction shown by the arrows in FIG. 2 in an upwardly and rearwardly direction into compartment 25. A conventional electrical or pneumatic vibrator 33 is secured to floor 26 to induce the floor to vibrate when the vibrator 33 is operational. A conventional blower 34 can be secured to trailer 10 in any convenient manner and is driven by conventional motor 36. A conventional heater (not shown) can also be associated with blower 34 so that the air blown by the blower can be heated. The blower 34 is connected by duct 38 to the duct 28 so that air driven by the blower can be injected into the duct 28. A jack 37 is connected to frame 12 to elevate the front end of the body 10 if desired.

In operation, a plurality of filled peanut shells or the like which are relatively lightweight in nature, are deposited in the compartment 25 from the harvesting mechanism. The peanut hulls are shown by the numeral 40 in FIG. 1. The end gate 22 would be in its vertical or closed position when the peanut hulls 40 are deposited into compartment 25.

The trailer 10 is then pulled or otherwise delivered to the processing elevator. At any time after the compartment 25 has been filled with the peanut hulls 40, the blower 34 can be actuated to force air through duct 38, thence into duct 28, and thence upwardly and rearwardly through slits 30.

After the peanut hulls 40 have been sufficiently and adequately dried, the peanut hulls can be unloaded from the trailer 10 by lowering the end gate 22 to the position shown in FIG. 1. The vibrator 33 can be made operational by conventional electrical or pneumatic controls to cause the floor 26 to vibrate. The blower 34 is actuated in the manner described above to continue to blow compressed air through slits 30 in the false bottom 26. The angular direction of the air passing through slits 30 will impact on the peanut hulls and blow them rearwardly towards the end gate 22. Continued operation of the blower will result in the peanut hulls being blown from compartment 25 to any convenient unloading station. The jack 37 can be used to elevate the front end of the body 10 to facilitate the movement of hulls rearwardly towards gate 22.

As a result of this invention, the prior functions of transporting, drying and unloading peanut hulls can be combined, resulting in a substantial savings of time and labor.

It is therefore seen that this invention will achieve at least all of its stated objectives.

What is claimed is:

1. A method of drying and conveying filled peanut hulls, comprising, taking a compartment having forward and rearward ends, a bottom, and opposite sides, forming a false bottom over said bottom to create an air duct therebetween, forming air ports in said false bottom which will deflect forced air passing therethrough from said air duct in a direction generally towards said rearward end, placing a quantity of peanut hulls in said compartment, forcing warm air into said air duct through said air ports and into said compartment to dry said peanut hulls, and moving said rearward end of said compartment to permit the air from said air ports to blow the dried hulls from said compartment out of said rearward end.

2. The method of claim 1 wherein vibrational motion is induced in said false bottom to facilitate movement of said dried hulls towards said rearward end.

3. The method of claim 1 wherein the forward end of said compartment is elevated with respect to said rearward end to facilitate movement of said dried hulls toward said rearward end.

4. The method of claim 3 wherein the forward end of said compartment is elevated with respect to said rearward end to facilitate movement of said dried hulls toward said rearward end.

5. The method of claim 1 wherein said peanut hulls are placed in said compartment at a first location, and thence transported in said compartment to a second location where said hulls are blown from the rearward end of said compartment.

6. A method of drying and conveying lightweight particulate material, comprising, taking a compartment having forward and rearward ends, a bottom, and opposite sides, forming a false bottom over said bottom to create an air duct therebetween, forming air ports in said false bottom which will deflect forced air passing therethrough from said air duct in a direction generally towards said rearward end, placing a quantity of lightweight particulate material in said compartment, forcing warm air into said air duct through said air ports and into said compartment to dry said lightweight particulate material, and moving said rearward end of said compartment to permit the air from said air ports to blow the dried hulls from said compartment out of said rearward end.

7. The method of claim 6 wherein vibrational motion is induced in said false bottom to facilitate movement of said dried hulls towards said rearward end.

8. The method of claim 6 wherein the forward end of said compartment is elevated with respect to said rearward end to facilitate movement of said dried hulls toward said rearward end.

9. The method of claim 8 wherein the forward end of said compartment is elevated with respect to said rearward end to facilitate movement of said dried hulls toward said rearward end.

10. The method of claim 6 wherein said peanut hulls are placed in said compartment at a first location, and thence transported in said compartment to a second location where said hulls are blown from the rearward end of said compartment.

11. A transporting, drying and unloading device for lightweight particulate material, comprising, a frame, a compartment on said frame having a bottom, opposite sides, a forward end, and open top, and a rearward end pivotal gate, a false bottom floor located in said compartment spaced from and substantially parallel to said bottom to create an air duct therebetween, a plurality of laterally extending slits in said false bottom floor with at least some of said slits having an upwardly and rearwardly extending baffle element so that air moving through said slits from said air duct will move upwardly and rearwardly into said compartment, and means associated with said air duct for receiving air under pressure to cause air moved through said slits.

12. The device of claim 11 wherein a means to impart vibrational motion is secured to said false bottom.

13. The device of claim 11 wherein frame has a lifting means to raise the forward end of said compartment with respect to said rearward end.

14. The device of claim 13 wherein frame has a lifting means to raise the forward end of said compartment with respect to said rearward end.

15. The device of claim 11 wherein said frame is wheel supported to permit movement of said compartment from place to place.

16. A drying and unloading device for lightweight particulate material, comprising, a frame, a compartment on said frame including a bottom and a wall structure thereon comprised of a plurality of substantially vertical wall elements, with at least one of said wall elements being movable from a vertical position, a false bottom over said bottom to create an air duct therebetween, a plurality of laterally extending slits in said false bottom floor with at least some of said slits having an upwardly and inclined extending baffle element so that air moving through said slits from said air duct will move upwardly and diagonally into said compartment, and means associated with said air duct for receiving air under pressure to cause air to bemoved through said slits towards said movable wall element.

17. A method of drying and conveying lightweight particulate material, comprising, taking a compartment having a bottom, and a wall structure therearound comprised of substantially vertical wall elements, at least one of said wall elements being movable from a vertical position, forming a false bottom over said bottom to create an air duct therebetween, forming air ports in said false bottom which will deflect forced air passing therethrough from said air duct in a direction generally towards said removable wall element, placing a quantity of lightweight particulate material in said compartment, forcing warm air into said air duct through said air ports and into said compartment to dry said lightweight particulate material, and moving said movable wall element of said compartment to permit the air from said air ports to blow the dried hulls from said compartment out of the opening crated by moving said wall element.

* * * * *